United States Patent [19]

Hug

[11] 4,336,849

[45] Jun. 29, 1982

[54] EARTH DRILLING DEVICE FOR EXTRACTING EARTH SAMPLES

[76] Inventor: Max Hug, Sagenmattstrasse 11, CH-6003 Luzern, Switzerland

[21] Appl. No.: 165,667

[22] Filed: Jul. 3, 1980

[51] Int. Cl.[3] ..... E21B 49/02

[52] U.S. Cl. ..... 175/246; 175/309; 175/58; 73/864.45

[58] Field of Search ..... 175/20, 58, 246, 226, 175/308, 309, 20, 170, 173; 173/33, 32; 138/119; 73/425.2, 425, 421 R

[56] References Cited

U.S. PATENT DOCUMENTS

| | | | |
|---|---|---|---|
| 1,109,446 | 9/1914 | Melberg | 73/425.2 |
| 3,429,386 | 2/1961 | Secrist et al. | 175/170 |
| 3,667,553 | 6/1972 | Gill | 175/20 |
| 3,828,473 | 8/1974 | Morey | 47/58 |
| 4,081,040 | 3/1978 | Henson | 175/246 |
| 4,156,469 | 5/1979 | Laskey | 175/58 |
| 4,161,988 | 7/1971 | Hart | 173/32 |
| 4,185,665 | 1/1980 | Flimon | 138/89 |

*Primary Examiner*—William F. Pate, III

*Attorney, Agent, or Firm*—Birch, Stewart, Kolasch and Birch

[57] ABSTRACT

An earth drilling device for extracting earth samples including a rotatable drill tube and means for rotating said drill tube, a drill bit supported by said rotatable drill tube, said drill bit and said drill tube defining an inner shoulder, a hollow probe movably disposed within said drill tube and adapted to be supported by said inner shoulder, an exchangeable plastic sleeve disposed within said hollow probe, and means for extracting said hollow probe and associated plastic sleeve containing an earth sample without removing the drill tube from the earth.

6 Claims, 6 Drawing Figures

EARTH DRILLING DEVICE FOR EXTRACTING EARTH SAMPLES

BACKGROUND AND SUMMARY OF THE INVENTION

The present invention is directed to an earth drilling device for taking earth samples having a rotatable drilling tube which supports a drill bit which in turn is provided with recessed depressions which accept an exchangeable plastic sleeve which serves as a sample container.

A device for taking earth samples is known from CH-Pat. No. 543.781. A sample container disclosed therein is a cylindrical sleeve made of a plastic material having a securely attached floor which is situated above during the drilling process. To allow trapped air to escape the sleeve as the drill core penetrates the sleeve the floor is perforated. These smooth walled sleeves, closed on one side of the floor, must be sufficiently rigid to be stored and transported and thus must have relatively thick walls. They also take up a considerable amount of space. Cylindrical, slip-on caps are provided to close off the earth sample lying in the sleeve. These caps, too, require a relatively large amount of space in storage and transportation.

The present invention provides a simple means which avoids these disadvantages. To this end the apparatus according to the present invention is characterized by the utilization of a sleeve which is open at both ends and comprises a thin plastic film which can be temporarily compressed flat for storage and transporting purposes and then expanded to a round cross-section when inserted into the drill tube. Two identical caps provided with conical slip-on collars are utilized for sealing both ends of the sleeve. A particularly advantageous sleeve form is characterized by the fact that the sleeve exhibits a polygonal cross-section. However, due to a large number of axis-parallel bends uniformly distributed around its circumference, it fits in conformity with the inner surface of the drill tube.

These sleeves are simple to produce, e.g., by longitudinally folding a flat cut-out, rolling it up and gluing or welding it along an overlapping seam. Such a sleeve could be easily folded more or less flat along to diametrically opposing folds for transportation or storage and opened into a round shape again for use within the drilling tube. The slight deformation or increased bending along two sleeve lines resulting from light flattening or bending can be smoothed out sufficiently by hand again that the sleeve assumes the desired round shape by itself when it is pushed into the drill tube.

The numerous folds in the longitudinal direction of the sleeve cause a certain stiffening of the sleeve so that it can be easily produced from a somewhat thinner film than is customary when using smooth-walled sleeves. The two associated caps provided for the polygon sleeve are not placed on the ends of the sleeve until the sleeve containing the drill sample is removed from the drill tube. The caps are purposely, slightly conical, thereby assuring not only that they seat securely on the sleeve but also that they can be stacked to save space by inserting one cap into an identical cap below it for storage and transportation purposes.

It has proven to be particularly advantageous to work with several telescoping drill tubes, whereby sleeves with correspondingly smaller diameter are associated with each inner, deeper-penetrating drill tube.

Thus, for example, earth samples up to several meters in depth are possible with sleeve segment lengths of 25 cm. Since a large number of sleeves is necessary in such cases, the mentioned, space saving transportable and storable polygon sleeves and their associated caps afford particular advantages.

It has been shown that earth samples taken at depths down to several meters are possible with a drilling device of the present type. It has been shown to be particularly advantageous to construct the drill tube as a multi-part telescopic tube in which the inner or innermost, deepest extending tube section is inserted into the next outer tube. This, of course, requires that the drill core sections, packed by means of the outer drill tube section in corresponding number of sleeve sheaths, be removed first. Then this outer, empty drill tube section is lowered again and now serves as a guide for the inner drill tube section with which the deeper earth samples in correspondingly smaller sample containers can be removed. It has been shown that this method can lead to problem-free samples only when the individual samples can be removed with the drill tube remaining in the earth. This is not possible with the conventional arrangement of the sample container directly on an inner shoulder in the drill tube formed by an offset in the latter. However, this problem is solved according to the present invention wherein an insert cylinder in the drill tube is adapted to accept the sample container by means of a rod extending from above. A device of this type for deep drilling is not only relatively heavy, but also requires a relatively strong, and therefore, heavy drive motor. With the conventional arrangement of the motor coaxially above the drill tube, the heavy motor must be removed when each sample is removed. This problem too is solved, according to the present invention, by the fact that the drill tube and its associated drive mechanism are supported by a waist plate. The drive motor is situated to the side of a coupling head disposed coaxial to the drill tube and is connected thereto. Thus, the sample container can be removed from the drill tube without separating the coupling head from the drill tube. This cuts down consideraly on the time needed to remove samples from greater depths of several meters or more.

BRIEF DESCRIPTION OF THE DRAWINGS

The present invention is described in greater detail hereinbelow with reference to the accompanying drawings, wherein.

DETAILED DESCRIPTION OF THE INVENTION

Figure 4:
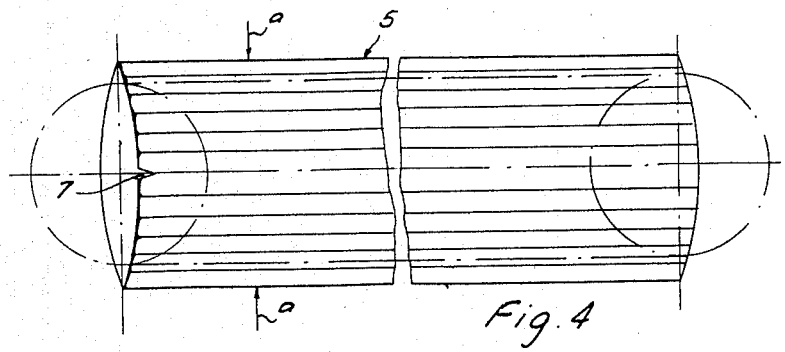
FIG. 4 shows a flattened, empty sample sleeve according to FIGS. 1–3 in horizontal projection.
Figure 3:
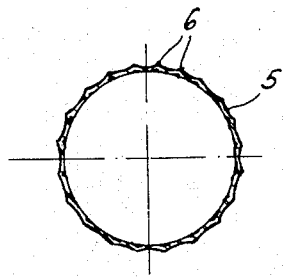
FIG. 3 shows a cross section taken along line III—III in FIG. 2.
Figure 2:
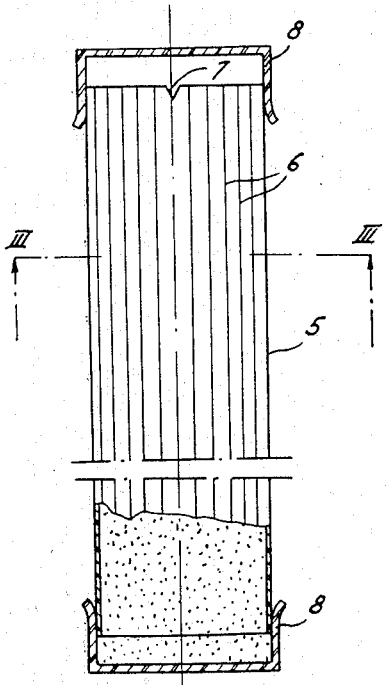
FIG. 2 shows a sample sleeve with associated end caps in axial section.
Figure 1:
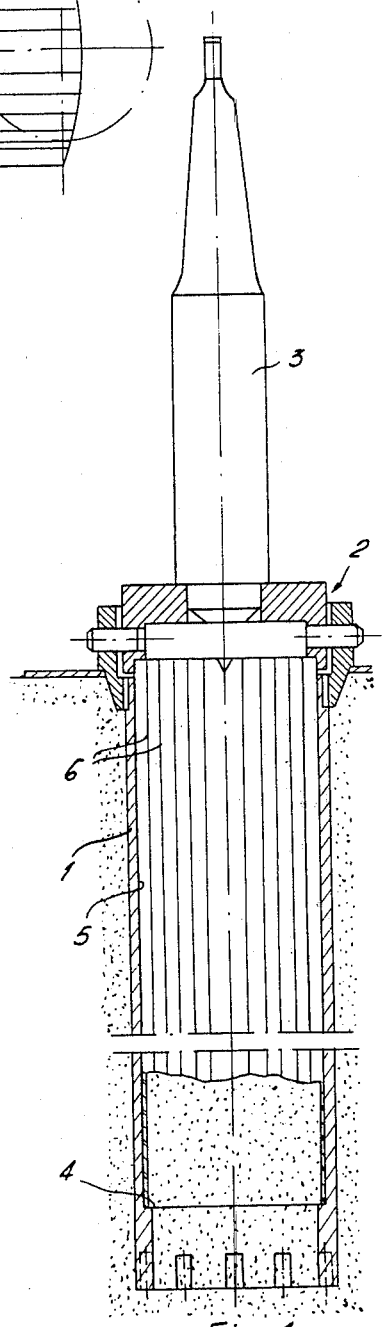
FIG. 1 shows an example of a drill tube in axial section with an inserted sample sleeve disposed within said tube in operating position.

According to FIG. 1 the drill tube 1, hardfaced with hard metal knives, is connected to the drive shaft 3 by means of a known coupling head 2. The sleeve 5 which serves as a sample container rests on a lower off-set shoulder 4. This sleeve consists of a relatively thin film of transparent plastic. The circumference of the sleeve has a polygonal form approaching that of a cylinder due the large number of folds 6 running along lines in the sheath. The one edge of the sleeve face 5 is provided with a marking notch 7. The folds 6 and the notch 7 can be produced in the same production step of cutting out the flat film section which forms the sleeve. Two identical caps 8 with conically extending collars are provided for the sleeve 5. The caps 8 are used to seal the sleeve 5 which contains the sample which has been removed from the drill tube 1 and they, too, are made of plastic. However, their wall strength is markedly greater than that of the sleeve. The caps are of different colors so that the top and bottom of the removed sample can be immediately recognized. Since both caps 8 are pressed onto the sleeves only after the sample has been taken into the sleeve 5, the caps can be stored and transported up to the moment of use, in form fitting, space saving stacks. The sleeves 5, on the other hand, can be easily pressed more or less flat, due to corresponding folds along two diametric fold lines 6 since they are without caps and because they are made of a thin film having little form stability. As a result, they require very little space for storage and transportation. Before use the sleeve 5 is brought back into a newly round shape by lightly pressing on the folds (arrow a in FIG. 4) and smoothing these folds, if necessary. Since their circumference corresponds substantially exactly to that of the interior of the drill tube, it automatically assumes the cylindrical shape of the drill tube when it is inserted into the tube.

Figure 5:
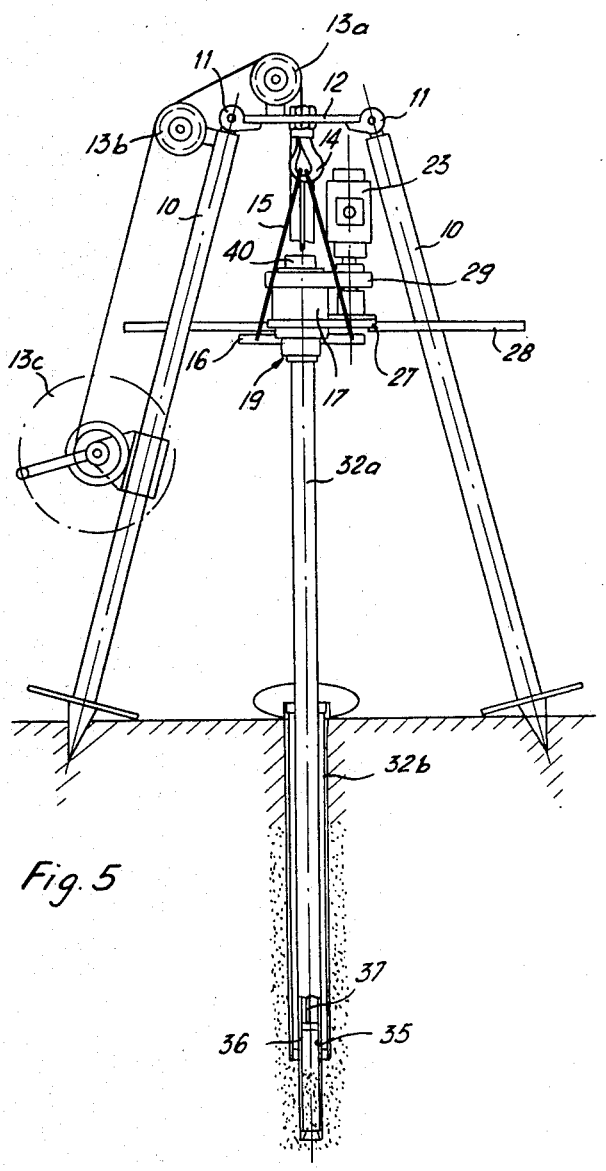
FIG. 5 shows in side view an example of a device with a telescopic drill tube in operating position according to the present invention.
Figure 6:
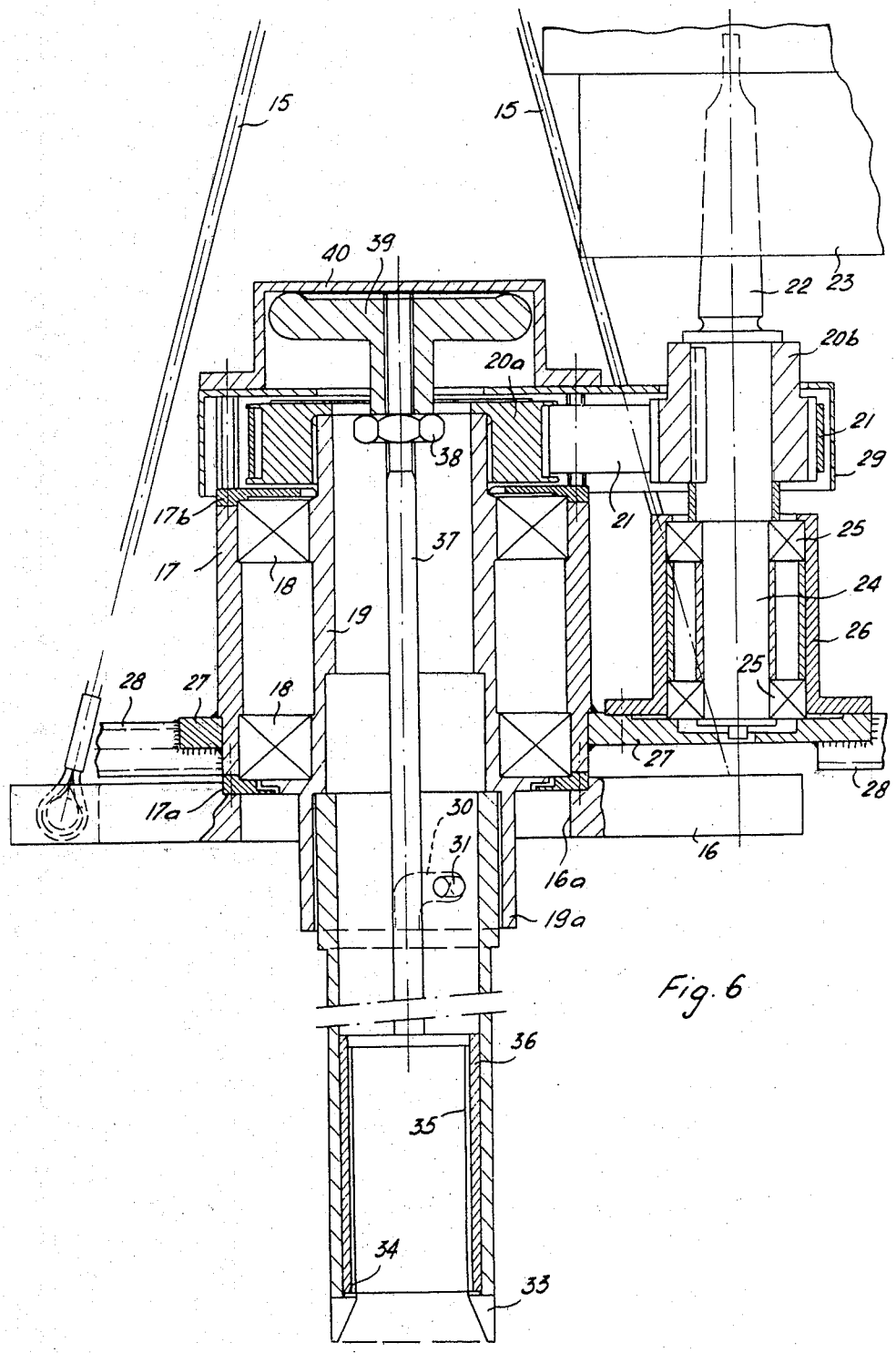
FIG. 6 shows a detail portion of FIG. 5 in larger scale and in axial section.

A particularly advantageous embodiment of a device for periodically removing earth samples up to great depths is shown in FIGS. 5 and 6. The device has a tripod whose legs 10 are connected at the top by rotating axled bolts 11 to a support plate 12. A cable pulley 13*a* is mounted on the support plate 12 provided with a central opening, and another cable pulley 13*b* and a cable drum 13*c* are attached to one of the tripod legs 10. The end of the cable which extends through the central opening in the support plate 12 has a hook 14. The drilling device to be described later is suspended on this hook 14 by means of three cable loops 15. The cable loops 15 attached to an anchor plate 16 above whose central opening 16*a* the lower end ring 17*a* of a bearing housing 17 is centrally supported. A hollow shaft 19 is mounted with ball bearings 18 in a housing 17 exhibiting an end ring 17*b* at the top. A belt wheel 20*a* sits on the upper end of the hollow shaft above the end ring 17*b*. The belt wheel 20*a* is connected via a belt 21 with a belt wheel 20*b* that rests on the drive shaft 24 which is connected via a cone 22 with the drive shaft of a drilling maching 23. The drive shaft 24, mounted with ball bearings 25 in a housing 26, is disposed parallel to the hollow shaft 19. Both bearing housings 17, 26 are mounted on a common waist plate 27, which is provided with laterally protruding hand grips 28. The wheels 20*a* and 20*b*, which form a lowering gear, are covered along with belt 21 by a belt guard 29 attached to the housing 17. Two angle slots 30 are provided on connection supports 19*a* which extend downward through the anchor plate 16. These angle slots 30 serve as attachment points for retainer bolts 31 by means of which the operative drill tube 32*a* is connected with the hollow shaft 19 which serves as a coupling head and as a result is connected through the transmission with the motor 23. In the present case, two telescoping drill tubes 32*a*, 32*b* are provided, whereby, according to FIG. 5, the drill tube 32*b* which is somewhat larger in diameter has already returned its drill section, remains in the earth, is disconnected from the hollow shaft 19. The inner drill tube 32*a* is shown in its operating position connected with the hollow shaft 19. Otherwise, both drill tubes are identically constructed. They have an inner shoulder 34 above their purposely exchangeable drill bits 33 on which a cylindrical probe 36 is supported. A sample container sleeve 35, consisting here of a thin transparent plastic film, and open at both ends is pushed into this probe. This sleeve 35, can also exhibit a folded polygon cross-section as described in FIGS. 1 through 4. Due to its low wall strength it too can be pressed more or less flat even without such folds, for storage and transport, without sustaining damage. The probe 36 containing the sample container 35 is attached to an upwardly extending rod 37, the end of which protrudes above the belt guard 29 and is provided with threads and supports a handgrip 39 which is axially adjustable and securable by means of a nut 38. This handgrip is covered by a removably attached hood 40 which, along with the belt guard 29 on the housing 17, can be removed. The hood 40, which serves as a stop for the grip 39, makes it possible to axially secure the rod 37, seated by means of the probe 36 on the drill tube rim 34. The hollow shaft 19 and an opening in the belt cover 29 aligned with it are dimensioned so that, after the hood 40 has been removed, the rod 37 with the probe 36 and the drilling sample contained in the sample container 35 can be removed to the top by means of the handgrip 40. Removing or disconnecting the motor 23 disposed to the side from the hollow shaft 19 or the drill tube is not required to do this. As a result of using a probe 36 separated from the drill tube to accept the sample container, the individual samples can be consecutively removed up until the maximum depth capable with the respective drill tube has been reached, without having to pull the drill tube up each time. Thereby the end sections of each respectively retrieved probe remain fully intact so that, despite the fact that the individual samples are removed in sections, a drill core which is undisturbed along the entire drilling depth can be retrieved. On the other hand, the cable allows the whole drilling unit to be raised, whereby in the case of a rotating drill tube, the tube can be pulled out of the drill hole. Due to the problem-free, central suspension of the drilling device on the tripod cable, the drill hole walls are hardly damaged at all. Drill holes produced in this manner lend themselves to use as long term check holes, e.g., to check the water table by inserting therein casings corresponding in size to the drill tubes used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

In summary, the rotating drill tube 32*a* is connected to a hollow shaft 19 and a gear with the laterally disposed drive motor 23. The drill tube 32*a* coupled to the hollow shaft 19 contains a rod 37 which can be removed to the top of the device together with a sleeve-shaped probe 36 which rests on a rim 34 provided in the drill tube 32*a* and which houses the plastic sleeve 5, 35 which is open at both ends and serves as a sample container. This allows periodic removal of the sample without disconnecting the motor 23 or pulling up the drill tube. The plastic sleeve 5, 35 consists of a thin-walled film which is closed with slip-on caps 8 after the sample is removed from the drill tube. The empty, thin sleeve can be pressed more or less flat for transportation and storage. To this end it is prefolded along many lines on its outer surface. Telescopic, drill tubes 32*a*, 32*b* which are successively connected with the motor 23 allow samples to be taken up to several meters in depth.

What is claimed is:

1. An earth drilling device for extracting earth core samples including, a rotatable drill tube and means for rotating said drill tube;

a drill bit supported by said rotatable drill tube, said drill bit and said drill tube defining an inner shoulder;

a hollow probe movably disposed within said drill tube and adapted to be supported by said inner shoulder;

an exchangeable thin plastic sleeve of uniform thickness disposed within said hollow probe, said sleeve containing a multiplicity of axis parallel pre-folds uniformly distributed along its circumference, and exhibiting a polygonal cross section which conforms to the circular inner circumference of said hollow probe to form a smooth, cylindrical receiving surface for said earth core samples when inserted in said hollow probe; and means for extracting said hollow probe and associated plastic sleeve containing an earth core sample without removing the drill tube from the earth.

2. The earth drilling device of claim 1 wherein the means for rotating the drill tube is a drive motor which is connected with a coupling head, which in turn is detachably connected with the drill tube, said drive motor being disposed laterally to and on an axis parallel to the coupling head.

3. The earth drilling device of claim 2 wherein the coupling head is a hollow shaft, said hollow shaft being connected to a bearing housing, said coupling head and drive motor being mounted on a common waist sheet.

4. The earth drilling device of claim 1 wherein the drill tube comprises a plurality of telescopically disposed penetrating drill tubes for taking consecutive samples at varying depths.

5. The earth drilling device of claim 1 wherein the hollow probe has a cylindrical shape and is attached to a vertically disposed rod and associated handgrip for removal from the drill tube.

6. The earth drilling device of any one of claims 1–5 wherein the coupling head is supported by an anchor plate which is suspended from a tri-pod and pulley means are operatively attached to said anchor plate.

* * * * *